United States Patent [19]

Cookson

[11] 4,189,856

[45] Feb. 26, 1980

[54] RUG HOOKING RACK

[76] Inventor: Leonard T. Cookson, 6539 N. 48th St., Paradise Valley, Ariz. 85253

[21] Appl. No.: 879,874

[22] Filed: Feb. 22, 1978

[51] Int. Cl.[2] ..... D05C 1/02; D06C 3/08

[52] U.S. Cl. ..... 38/102.4; 38/102.91; 289/18.1

[58] Field of Search ..... 38/102.4, 102.5, 102.6, 38/102.7, 102.91; 28/149, 151, 152; 289/18, 18 R; 160/373, 374, 375, 378, 380

[56] References Cited

U.S. PATENT DOCUMENTS

| | | | |
|---|---|---|---|
| 800,591 | 9/1905 | Payen | 38/102.4 |
| 1,524,732 | 2/1925 | De Forest | 38/102.91 |
| 2,691,203 | 10/1954 | Wilder | 28/149 |
| 2,802,254 | 8/1957 | Valva | 28/149 |
| 2,832,171 | 4/1958 | Batey | 38/102.91 |
| 3,098,280 | 7/1963 | Harris et al. | 38/102.4 |
| 3,621,541 | 11/1971 | Watkins | 28/149 |
| 3,800,372 | 4/1974 | Daoust | 28/152 |
| 3,922,804 | 12/1975 | Batey | 38/102.91 |
| 3,970,338 | 7/1976 | Crowe | 289/18 R |
| 4,102,065 | 7/1978 | Selden | 28/149 X |

FOREIGN PATENT DOCUMENTS

| | | | |
|---|---|---|---|
| 2204195 | 5/1974 | France | 289/18 R |
| 608550 | 9/1948 | United Kingdom | 289/18 |

*Primary Examiner*—Louis Rimrodt

*Attorney, Agent, or Firm*—Blanchard, Flynn, Thiel, Boutell & Tanis

[57] ABSTRACT

A rug hooking rack, in both a floor model and a readily supportable table model, is provided for positively holding, but incrementally feeding as desired, the base material upon which the hooking operation is being performed. Means are also provided for holding said base material firmly against a working surface at a point closely adjacent the zone in which work is being performed, whereby to facilitate such work both as to ease of performance and, in many instances, the quality of the finished work.

10 Claims, 11 Drawing Figures

FIG. 1
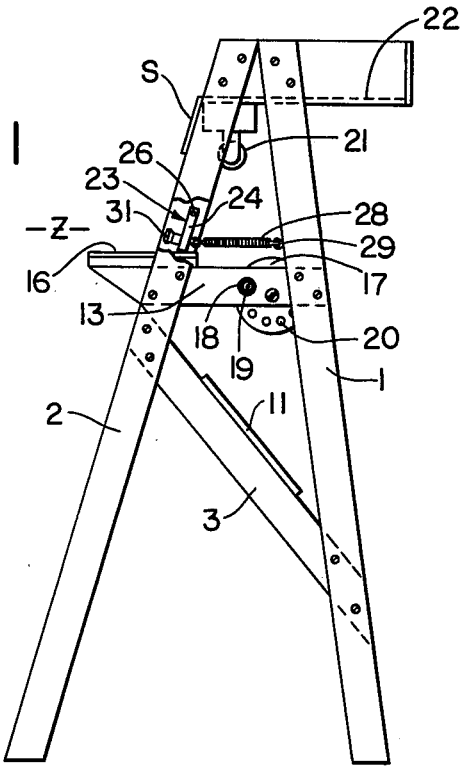
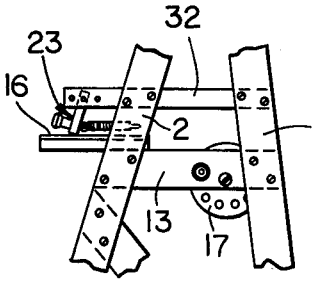
FIG. 4
FIG. 2
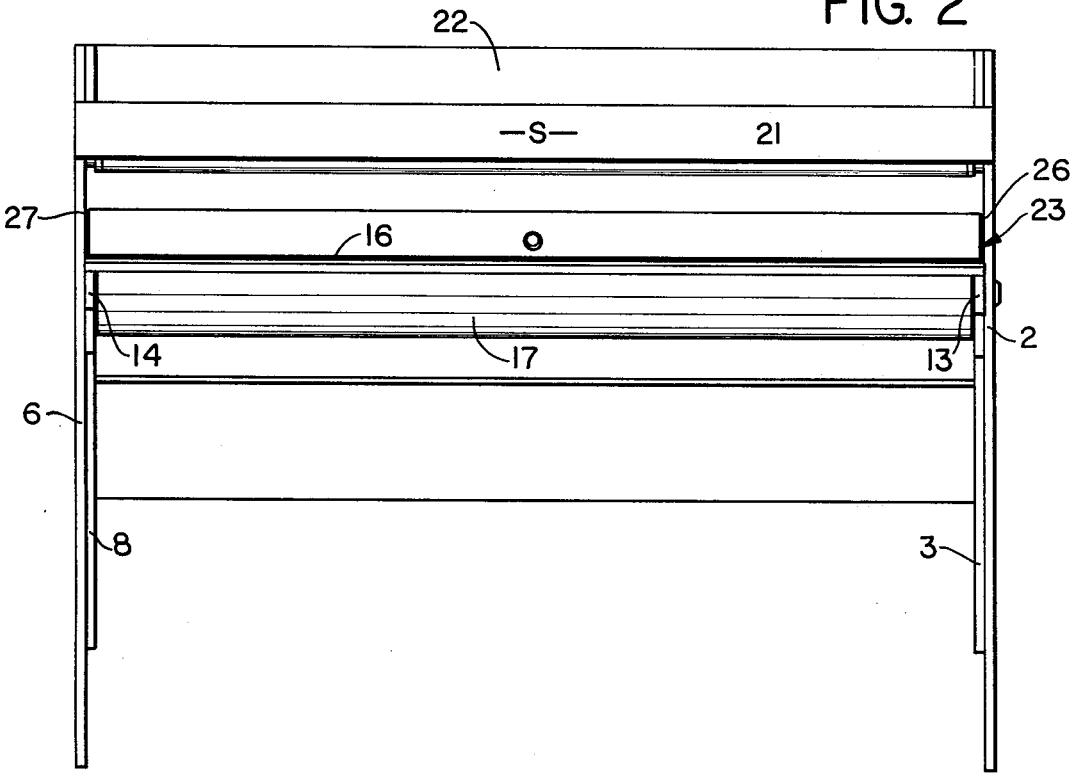

RUG HOOKING RACK

FIELD OF THE INVENTION

The invention relates to rug hooking devices and relates particularly to such devices in which the base material upon which the hooking operation is being performed may be positively held but incrementally fed as desired by the operator and further in which there is provided hold-down means for positive holding against fixed means a portion of said base adjacent that upon which the hooking operation is being performed.

BACKGROUND OF THE INVENTION

The so-called "hooking" of rugs is an old art and many devices have been proposed over the years for facilitating same. In a more recent development of this art, there has appeared a procedure wherein a sheet of flexible base material is provided with suitable openings therethrough, as by being woven with a large mesh, wherein the base material is fed to the operator under a controllable restraint and wherein the hooking operation is performed by introduction of the desired rug materials into and through such openings in said base. This development of the art has also given rise to a large number of devices by which the base material may be held and fed to the operator as desired with the finished portion of the rug then moving to some portion which is clear of the working zone. These devices in greater or less complexity have in the past provided means for holding the base material and incrementally feeding it into a working zone as required by the operator and they have done so with greater or less degrees of convenience to the operator. However, in the operation of rug hooking, it is further desirable to provide means for holding said base substantially immovably in a zone close to the working zone and none of the prior devices of which I am aware provide this function. The need for same has been recognized in the past inasmuch as certain instructions for rug hooking have suggested placing weights, as books, on top of the base adjacent the working zone but none insofar as I am aware have provided means for such holding within the structure of the rack itself.

Accordingly, the objects and purposes of the invention include:

1. To provide a rug hooking rack for supporting and incrementally feeding a base material to a working zone which rack will be simple to make, effective in use and easily converted from a collapsed to operating condition and vice versa.

2. To provide a rug hooking rack, as aforesaid, which includes also clamp structure by which the operator may if and when he so desires hold such base material firmly against fixed means at a point adjacent the working zone whereby to improve the firmness with which a hooking operation may be performed with respect to a particular segment of such base material.

3. To provide a rug hooking device, as aforesaid, which may be expressed in either a relatively simple and portable table model and/or in a somewhat more permanent free-standing model.

4. To provide rug hooking devices, as aforesaid, which will be extremely simple in manufacturing but will be durable and capable of long and satisfactory use.

5. To provide rug hooking devices, as aforesaid, which will hold such base material firmly when the operator so desires but which may by a simple manipulation be enabled to advance such base material incrementally as desired by the operator.

6. To provide rug hooking devices, as aforesaid, which will operate easily and freely when so desired by the operator but which when in clamped condition will hold a base material firmly against any strains normally placed thereon by the rug hooking operation.

Other objects and purposes of the invention will be apparent to persons acquainted with apparatus of this general type upon reading the following specification and inspection of the accompanying drawings.

BRIEF DESCRIPTION OF THE DRAWINGS

In the drawings:

FIG. 1 is a side view of a floor model of a rug hooking device incorporating the invention.

FIG. 2 is a view of the device of FIG. 1 from the side thereof faced by the operator when same is in use.

FIG. 4 is a fragment of FIG. 1 illustrating a modification.

DETAILED DESCRIPTION

Figure 3:
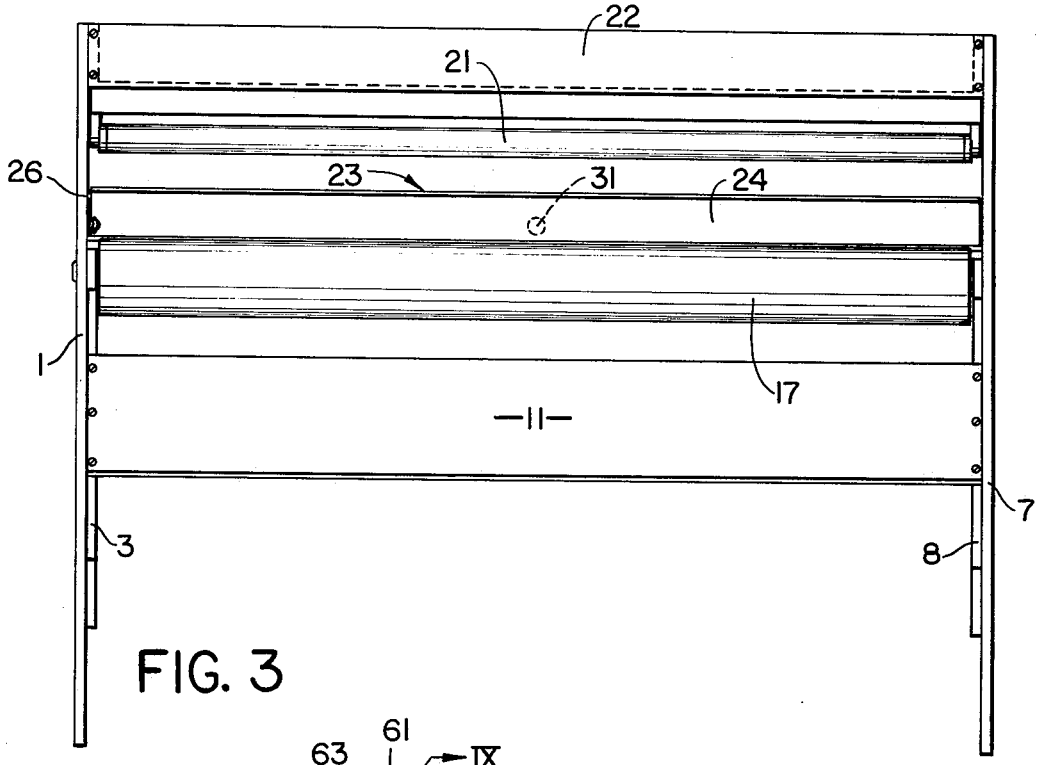
FIG. 3 is a view of the device of FIG. 1 from the side thereof facing away from the operator when same is in use.
Figure 5:
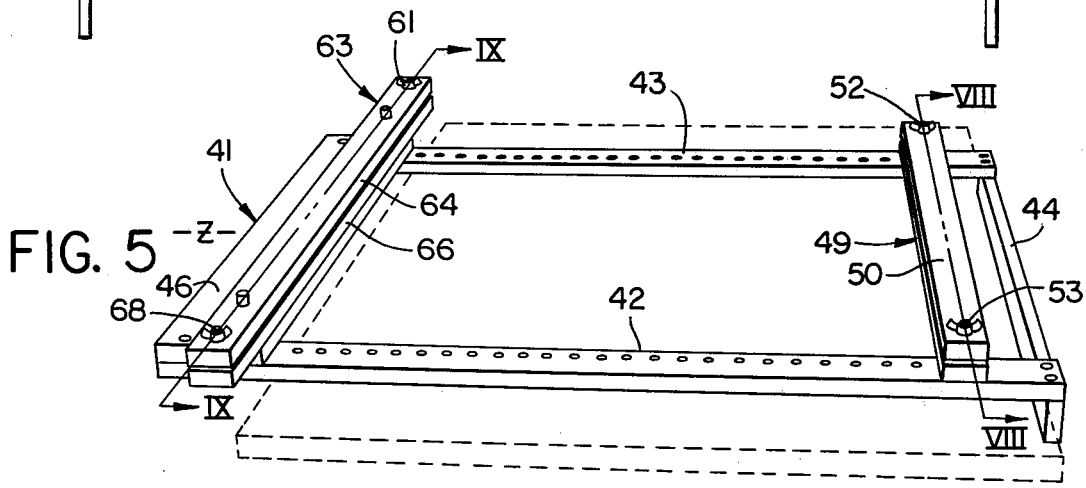
FIG. 5 is an oblique view of an embodiment of the invention adapted for use on a table.

Referring first to FIGS. 1, 2 and 3, there is provided frame structure comprising legs 1 and 2 connected together at their respective upper ends by any convenient longitudinal element, here a shelf and light shade S, and strengthened by a brace 3. Similar structure is provided at the other end of the machine and comprises legs 6 and 7 and a brace 8. A further longitudinal element 11 connects the two brace members.

Table structure is provided comprising a brace member 13 removably fixed as by bolts to the leg members 1 and 2. A similar brace member 14 is similarly fixed to the leg members 6 and 7. A table 16 connects the table support members 13 and 14. A roll 17 is pivotally mounted on the table support members 13 and 14 and is fixed for incremental advancement by any convenient means, such as an opening 18 in the support member 13 registerable with a selected one of a series of selectable openings 20 in the end of the roll 17 into which a pin 19 can be inserted.

The base material for the rug hooking operation is wrapped around the roll 17, extended across the top of the table 16 and back out of the operator's way, preferably by being led above the longitudinal member 11.

A light 21 and shade S may be provided if and as desired. The light shade S may also include shelf structure 22 which will further function as a connecting member between the end structures.

Forward clamp structure 23 is in this embodiment provided by a clamp member 24 pivoted at its one end at 26 to the leg 2 and its other end 27 to the leg 6. The spacing of said pivot point 26 (and its counterpart at the other end of clamp member 24) from the surface of the table 16 is such that the clamp will interfere with and bear against said table when same is rotated in a counterclockwise direction as viewed in FIG. 1 but same can be released from such contact with said table upon rotation in a clockwise direction as viewed in FIG. 1. A resilient device, such as the spring 28, is fixed between the clamp 24 and a suitable anchor point, such as the anchor point 29 on leg 1, and continuously urges said clamp for rotation in a counterclockwise direction. A handle 31 may be provided if desired to facilitate manual pivoting of said clamp in a clockwise direction.

With the base material above mentioned extending from the roll 17 under the clamp 23 and across the table 16 as above described, the hooking operation is carried out adjacent the end of said table, normally in the zone Z. In such case, the pin 19 will be inserted into the opening 18 and a selected opening 20 in registry therewith on said roll to prevent rotation of the roll 17 and the clamp 23, being urged by the resilient means 28 against said base, will hold said base material down firmly against the table as desired to facilitate the hooking operation. When it is desired to advance such base material, the pin 19 is merely withdrawn sufficiently to free the roll 17 and the base material is pulled toward the operator the desired distance. When the base material is so pulled toward the operator, the clamp provides no interference and no manipulation thereof is desired. However, if for reasons of inspection or otherwise it is desired to release the clamp entirely, it is a simple matter to grasp the knob 31 to pivot the clamp as far as desired and when the reason therefor has been satisfied, the clamp may be released and it will resume its normal function as above described.

It will be apparent that by appropriate proportioning of the apparatus the clamp 23 may be placed adjacent the rearward edge of the table 16 as shown or it may be placed as far toward the forward edge of said table as desired. It is further possible by providing a further member 32 (FIG. 4) extending between legs 1 and 2, and similar construction at the other end of the frame unit, to mount the clamp adjustably as desired by the operator for any given hooking device. This provides a wide range of flexibility in the use of said clamp according to the desires of the operator.

MODIFICATION OF FIGS. 5 TO 9

In this form of the apparatus, there is provided a base frame 41 comprising side members 42 and 43 and fixed end members 44 and 46. End member 44 is preferably fixed to extend downwardly from said side members in order to hook against the edge of a table as shown while end member 46 is provided across the top of said side members, and fixed thereto such as by screws 45, to provide a table functionally similar to the table 16 of FIGS. 1–3 adjacent the working zone Z. Said side members are provided with rows 47 and 48 of spaced openings for purposes appearing hereinafter. Openings 76 and 77 (FIGS. 7 and 9) are provided in end member 46 and are respectively in registry with a pair of the openings 78 and 79 in the side members 42 and 43. In this embodiment the rows of holes 78 and 79 are respectively offset from the rows of holes 47 and 48 (see FIG. 9).

Figure 8:
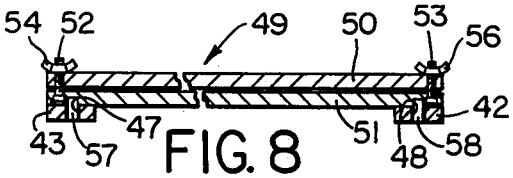
FIG. 8 is a section taken on the line VIII—VIII of FIG. 5.

An incremental clamp 49, corresponding functionally to the roll 17 in FIGS. 1–3 here comprises a pair of clamp members 50 and 51 which are held clampingly together in any desired manner, such as by bolts 52 and 53 and wing nuts 54 and 56. Pins 57 and 58 (FIG. 8) project from the lower clamp member 51 and are respectively receivable within the openings of the rows 47 and 48. Thus, a sheet of base material may be placed between said members 50 and 51, the wing nuts screwed down to fix same firmly therebetween and the pins 57 and 58 placed in the pair of openings furthest from the end of table member 46. As work progresses, the clamp member 49 is advanced one pair of openings at a time, or more if the operator so desires, along the rows 47 and 48 until the clamp 49 reaches a position close to the table member 46 at which said clamp may be relocated and the process repeated.

Figure 6:
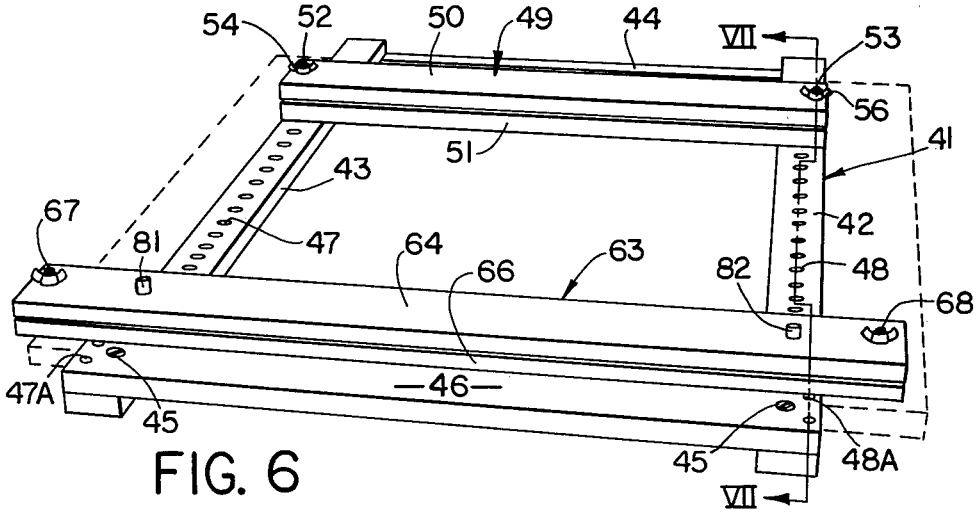
FIG. 6 is an oblique view of the device of FIG. 5 as seen from the side faced by the operator when same is in use.
Figure 9:
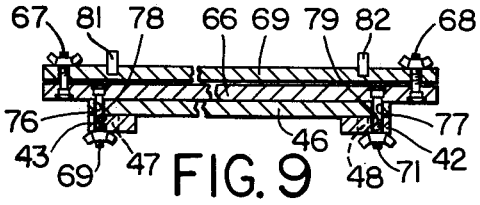
FIG. 9 is a section taken on the line IX—IX of FIG. 5.

There is also provided a further clamp 63, corresponding functionally to the hold-down clamp 23 of FIGS. 1–3. This comprises a pair of members 64 and 66 which may be gripped together by any convenient manually operable means such as the bolt and wing nut assemblies 67 and 68 (FIGS. 6 and 9). In addition, further bolts 69 and 71 (FIG. 9) extend from the lower clamp member 66 through selected ones of the openings 76 and 77, together with the ones immediately therebelow of openings 78 and 79, and are fixed in place by wing nuts of which one appears at 74. Preferably, the bolts 69 and 71 of said clamp 63 will pass through the ones of the openings 76 and 77 (and 78 and 79) as to enable the clamp 63 to be as close as possible to the work zone Z. Thus, as the work is advanced by moving the clamp 49 forward as above described, it will be released and relocated in the hold-down clamp 63 by releasing the wing nuts associated with bolts 67 and 68, moving the work forward the distance desired and then retightening said wing nuts.

It will be seen that this form of the invention is very simple to make, can be rendered operational merely by placing same on a table as shown and may be lifted off from such table at any time desired when the work is interrupted and stored without the necessity of releasing the work from either of the clamps there provided. It is thus very simple and hence inexpensive to make but is extremely versatile and fully effective in use.

Figure 10:
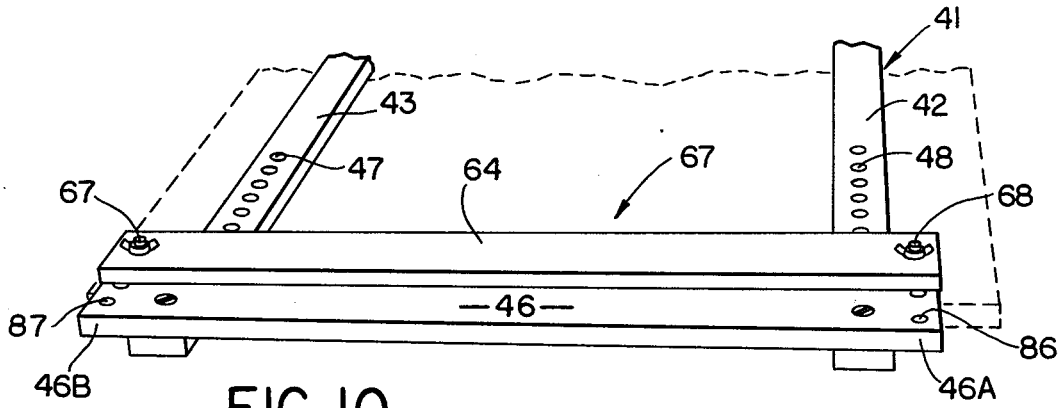
FIGS. 10 and 11 correspond to FIGS. 6 and 9 but illustrate a modification.
Figure 11:
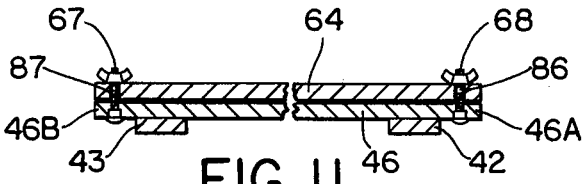

It will be apparent that functionally the lower clamp member 66 is in part a working surface spaced from the table member 46. Thus, if desired, and as illustrated in FIGS. 10 and 11, said lower clamp member may be eliminated and the upper clamp member 64 may operate directly on and with respect to the working surface of said table member 46. In such case, the table 46 is extended endwise to provide extensions 46A and 46B (FIGS. 10 and 11) and the bolts 67 and 68 extend into selected ones of a series of holes 86 and 87 therein.

Figure 7:
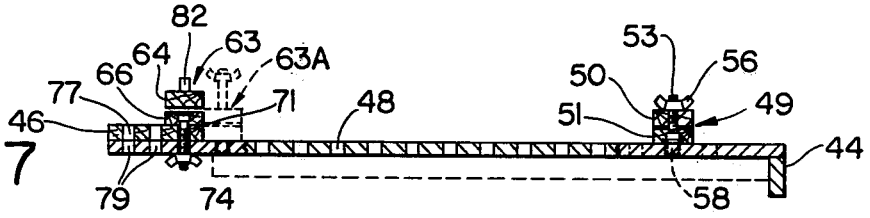
FIG. 7 is a section taken on the line VII—VII of FIG. 6.

A further possibility recognizes that one of the clamp members 64 and 66 may be a continuation of the working surface of the table 46, especially if said clamp member is placed in the position indicated by broken lines 63A in FIG. 7. Thus, one may provide clamp member 64 with the pins 81 and 82 which are sized and spaced to fit into a pair of the openings 47 and 48. With this, if desired, the clamp 63 may be inverted as shown at 63A and the pins 81 and 82 inserted into a pair of openings 47 and 48 whereby the lower member becomes flush with the table 46.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A device for holding base material in a rug hooking operation comprising in combination:

means providing a table surface and frame means holding said table surface in selected fixed relationship to a base support;

restraining means holding a sheet of base material for said hooking operation in fixed relationship to said table surface and for advancing said sheet of base material stepwise at the will of an operator toward said table surface;

hold-down clamp means adjacent said table surface, having continuously opposed parts relatively shiftable for sandwiching said base material both loosely to permit free sliding thereof through said hold-down clamp means and, alternately, fixedly with respect to said table surface.

2. The device of claim 1 wherein said hold-down clamp means parts comprise a portion of said table surface and a transverse member mounted to move into and out of contact with said table surface and including also resilient means permitting said movement while constantly urging said movable clamp member toward said table surface portion.

3. The device of claim 1 wherein said hold-down clamp means parts comprise a bar extending across and above a portion of said table surface, a pair of rods fixed to opposite ends of said bar and extending through said table surface and threaded means on said rods for releasably urging said bar toward said table surface, said table surface being wider than and extending beyond said bar in a direction away from said restraining means.

4. The device of claim 1 wherein said frame means comprises a pair of parallel longitudinal members and a spaced pair of cross members fixed thereto, one of said cross members depending from said longitudinal members in a manner to hang past and catch the edge of a supporting table to provide such base support and the other of said cross members comprises said table surface, said restraining means being shiftable stepwise along said longitudinal members between said cross members.

5. The device of claim 4 wherein said restraining means comprises a pair of bars spanning and resting atop said longitudinal members and arranged in parallel and face-to-face relationship with each other, manually operable means for releasably urging said bars toward each other to fixedly sandwich said sheet therebetween while permitting free movement of the bar pair along or off said longitudinal members and indexable means independent of said manually operable means for holding said bar pair in each of a series of selected positions along said longitudinal members.

6. The device of claim 5 wherein said indexable means includes a row of spaced openings in each of said longitudinal members and pins receivable into said openings fixed to one of said bars of said restraining means.

7. A device for holding a sheet of base material in a rug hooking operation comprising in combination:

frame means including spaced longitudinal members free of impediments to longitudinal advancement of said base material sheet therebetween and means for providing a table surface extending transversely of said longitudinal means for slidably supporting a sheet of base material for longitudinal advancement across said table surface to a working zone downstream of said frame means, said frame means holding said table surface in selected fixed relationship to a base support;

restraining means on said frame upstream of said table surface for holding said sheet of base material fixed against unintended advancement toward said table surface during hooking and advanceable stepwise by the operator for advancing said sheet of base material longitudinally stepwise toward said table surface;

hold-down clamp means including an upper clamp member extending transversely of said frame means downstream of said restraining means and overlying the path of said sheet above a portion of said table surface, to sandwich said sheet therebetween, means normally forcing said upper clamp member down against said portion of said table surface for frictionally restraining said sheet therebetween during hooking and merely loosenable by said operator for pulling of said sheet freely slidably across said table with or following a said stepwise advancement of the upstream portion of said base material sheet, the sheet-engaging surfaces of said hold-down clamp means being free of projections capable of penetrating said base material.

8. The device of claim 7 including pivot means pendently supporting said hold-down clamp member above said portion of said table surface for swinging into contact with said table surface and away, said forcing means including resilient means constantly urging swinging of said pivoted clamp member in the direction toward said table surface to resiliently clamp said sheet.

9. The device of claim 8 wherein said frame means comprises a free-standing structure for support upon a floor and wherein said restraining means comprises an indexable roller upon which may be wrapped said base material and wherein said table surface is supported between a pair of floor supported members adjacent the side of said frame member.

10. The device of claim 7 wherein said hold-down clamp member and said portion of said table surface comprises upper and lower bars lying in face-to-face parallel relationship with each other, said lower bar having an upper surface stepped above and parallel with the remainder of said table surface;

a pair of rods fixed to the upper of said bars and extending through the lower thereof and also through said frame means and manually operable releasable means on said rods for releasably urging said bars toward each other.

* * * * *